United States Patent [19]

Hirai et al.

[11] Patent Number: 5,058,545

[45] Date of Patent: Oct. 22, 1991

[54] OIL PAN FOR INTERNAL COMBUSTION ENGINE

[75] Inventors: Toshihiro Hirai, Yokohama; Shuji Kurosaka, Kawasaki; Kazuo Furukawa, Yokohama, all of Japan

[73] Assignee: Nissan Motor Co., Ltd., Yokohama, Japan

[21] Appl. No.: 575,480

[22] Filed: Aug. 31, 1990

[30] Foreign Application Priority Data

Sep. 7, 1989 [JP] Japan ..... 1-105013[U]

[51] Int. Cl.[5] ..... F02F 7/00

[52] U.S. Cl. ..... 123/195 C; 184/106

[58] Field of Search ..... 184/106; 123/195 R, 123/195 C, 198 E

[56] References Cited

U.S. PATENT DOCUMENTS

| | | | |
|---|---|---|---|
| 2,618,351 | 11/1952 | Giacosa | 184/106 |
| 3,189,126 | 6/1965 | May | 184/106 |
| 3,354,988 | 11/1967 | Leonard | 184/106 |
| 3,653,464 | 4/1972 | Jacobsen et al. | 184/6.2 |

FOREIGN PATENT DOCUMENTS

| | | | |
|---|---|---|---|
| 1919040 | 7/1977 | Fed. Rep. of Germany | 184/106 |
| 3436153 | 4/1986 | Fed. Rep. of Germany | 184/106 |
| 53-16048 | 5/1978 | Japan . | |
| 2008673 | 6/1979 | United Kingdom . | |
| 2230296 | 10/1990 | United Kingdom . | |

*Primary Examiner*—Noah P. Kamen

*Attorney, Agent, or Firm*—Foley & Lardner

[57] ABSTRACT

An oil pan for an internal combustion engine having an engine lubrication system. The oil pan comprises a shallow bottom section and a sump. The shallow bottom section includes an inclined surface which gradually becomes lower in level toward the sump and toward the downstream of the oil flow caused by the rotation of the crankshaft. Therefore, the lubrication oil dropped on the shallow bottom section is effectively returned into the sump through the lower side of the inclined surface under the action of a force caused by the rotation of the crankshaft or the like.

13 Claims, 7 Drawing Sheets

OIL PAN FOR INTERNAL COMBUSTION ENGINE

BACKGROUND OF THE INVENTION

1. Field of the Invention

The present invention relates to improvements in an oil pan for an automotive vehicle, and more particularly to the oil pan in which the oil dropped on the oil pan is rapidly returned into a sump.

2. Description of the Prior Art

It is well known that an internal combustion engine is provided with an oil pan having a sump into which lubrication oil dropped in the oil pan is collected to be fed to various sections of the engine by an oil pump In order to effectively return the lubrication oil into the sump, it has been proposed that an oil pan has a plurality of guide ribs on a shallow bottom section of the oil pan as shown in the FIGS. 15 and 16 of the present application. Such an arrangement is disclosed, for example, in Japanese Patent Publication No. 53-16048.

As shown in FIGS. 15 and 16, an oil pan 51 includes a sump 52 which is disposed under a cylinder block and extends along the axis of a crankshaft 54. A shallow bottom section 53 of the oil pan 51 is disposed under the cylinder block and defines a space which is communicated with the sump 52. An oil strainer (not shown) is disposed in the sump 52. A generally straight rib 57 is formed at the upper surface of one side of the shallow bottom section 53 which is located downstream of the oil flow caused by the rotation of the crankshaft 54. The straight rib 57 extends generally in the longitudinal direction of the engine 50. A plurality of arcuate ribs 56 are formed at the upper surface on the other side of the shallow bottom section 53 which is located upstream of the oil flow caused by the rotation of the crankshaft 54. Lubrication oil in the shallow bottom section 53 is collected under the rotation of the crankshaft. This causes lubrication oil to be rapidly returned from the shallow bottom section 53 into the sump 52. The shallow bottom section 53 is located considerably near the crankshaft since modern engines have become formed smaller However, with this conventional arrangement, lubrication oil guided by the ribs 56 flows into the sump 52 through a flat section 59 which is formed between the straight rib 57 and the end **56*a* of the each arcuate rib 56. Additionally, since the width of the flat section 59 gradually becomes narrow in the direction of the sump 52 while the amount of the oil directed to the sump 52 is increased on the flat section 59 with approaching to the sump 52, the oil on the flat section 59 overflows the ribs 56 and 57 in the vicinity of the sump 52 and is splashed by the air flow force caused by the high speed rotation of the crankshaft 54 and the connecting rods, so that the oil is prevented from returning into the sump 52. Furthermore, since the flat section 59 is located just under the crankshaft 54 to have a short distance relative to the crankshaft 54 and the connecting rods, the oil on the flat section 59 strongly receives the air flow force caused by the high speed rotation of the crankshaft 54 and the like, so that the oil is further prevented from returning into the sump 52**.

Therefore, the oil tends to be splashed by the crankshaft 54 and connecting rods 55. This causes the problems that the oil amount lacks in the sump 52, and therefore air is sucked into an oil flowing circuit through the oil strainer. Thus, a large amount of air bubbles is mixed with the oil.

SUMMARY OF THE INVENTION

It is an object of the present invention to provide an improved oil pan for an internal combustion engine with which lubrication oil in a shallow bottom section can be effectively returned in a sump, overcoming the drawbacks encountered in conventional oil pans.

An oil pan for an internal combustion engine, comprises a sump which is located under a cylinder block of the engine. The sump stores lubrication oil therein. A shallow bottom section is fixedly disposed under a cylinder block of the engine, and sealingly connected with the sump defining means. The shallow bottom section is located higher in level than a bottom of said sump and includes an inclined surface which gradually becomes lower in level toward the sump and toward a downstream side of an oil flow caused by rotation of the crankshaft. The shallow bottom section is fluidly communicated with the sump.

With the thus arranged oil pan, since the flow of lubrication oil caused by the crankshaft under rotation can be used for returning the oil to the sump, the oil on the shallow bottom section can be rapidly returned into the sump section through the inclined surface of the shallow bottom section. Therefore, a sufficient amount of lubrication oil is always stored in the sump, thereby suppressing the mixing of the air into the oil.

BRIEF DESCRIPTION OF THE DRAWING

In the drawings, like reference numerals designate like elements and parts throughout the figures, in which.

DETAILED DESCRIPTION OF THE INVENTION

Figure 1:
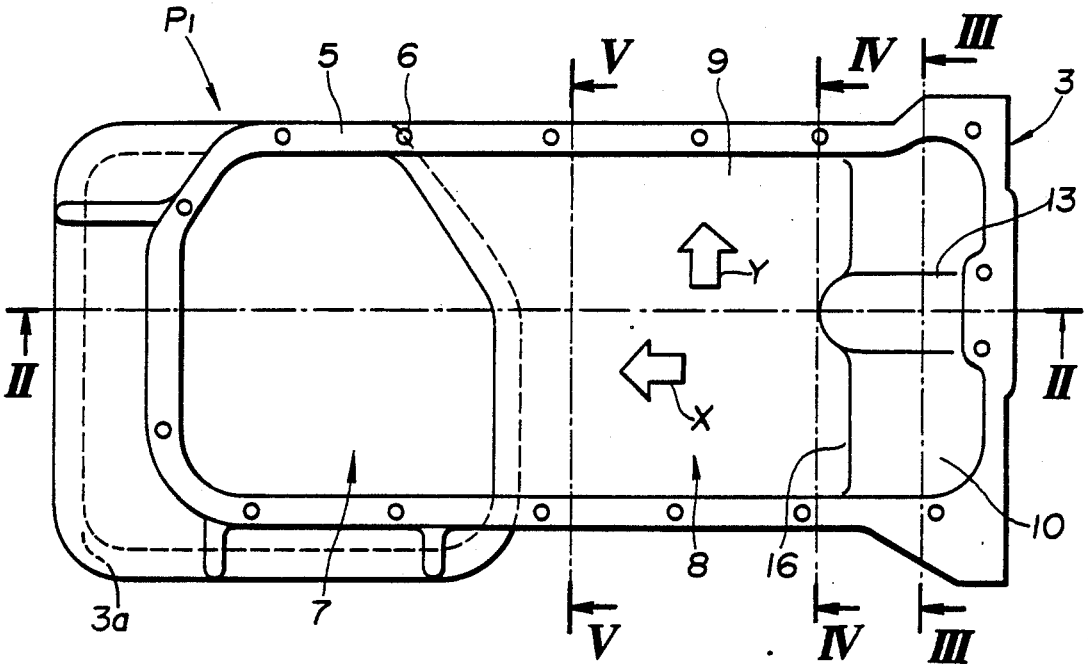
FIG. 1 is a plan view of a first embodiment of an oil pan according to the present invention.
Figure 2:
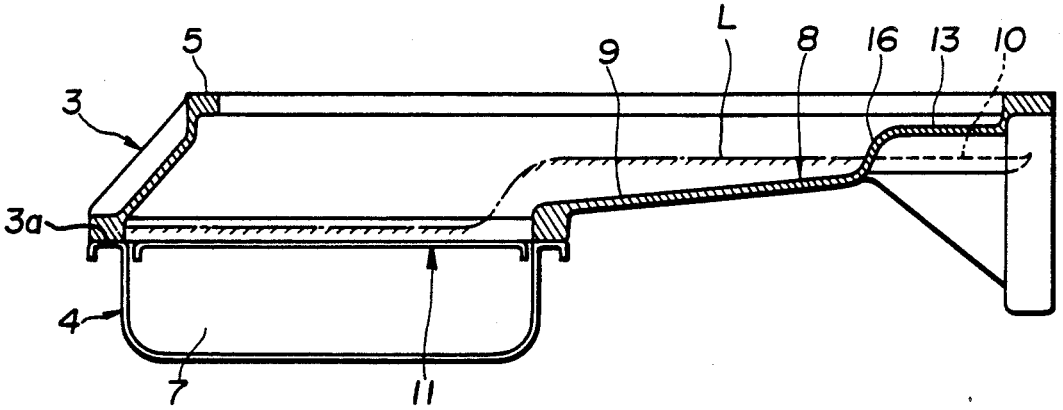
FIG. 2 is a vertical cross-sectional view of the oil pan taken in the direction of arrows substantially along the line II—II of FIG. 1.

Referring now to FIGS. 1 to 5, a first embodiment of an oil pan for a multi-cylinder internal combustion engine, according to the present invention is illustrated by the character $P_1$. The oil pan $P_1$ comprises an upper oil pan 3 made of aluminum alloy casting. A lower surface 3a of the upper oil pan 3 is fixedly secured to a lower oil pan 4 made of sheet metal, with bolts (not shown). The lower oil pan 4 defines a sump 7 in which lubrication oil is stored while the upper oil pan 3 has a shallow bottom section 8 through which lubrication oil is returned into the sump 7. The lubrication oil is supplied to various parts in the engine for lubrication upon being sucked by an oil pump (not shown). Finally, the lubrication oil is returned to the upper oil pan 3 and the lower oil pan 4. The oil pan $P_1$ is secured to a cylinder block (not shown) of the engine through an endless or continuous flange 5 which is formed integral with the upper oil pan 3. The flange 5 is formed with bolt holes 6 which are located with a predetermined distance between adjacent holes 6.

A baffle plate 11 for suppressing the shake of the lubrication oil and the movement of an oil level L is fitted to the upper part of the lower oil pan 4 to cover the sump 7. The baffle plate 11 is formed with openings or slits through which the lubrication oil flows from the upper oil pan 3 to the lower oil pan 4, though not shown.

The shallow bottom section 8 of the upper oil pan 3 includes a back end bottom 10 which is generally horizontally formed at the rear part of the shallow bottom section 8. The back end bottom 10 has a predetermined distance from the outer-most loci of counterweights (not shown). The back end bottom 10 has a bulge 13 at its center to form an arc-shaped cross-section as viewed from the axial direction of the crankshaft (not shown). A space formed under the bulge 13 is served as an operation space with which a transmission (not shown) and the like are installed to the engine.

The shallow bottom section 8 further includes an inclined surface 9 which is integrally connected with the back end bottom 10 through a step section 16 through which the inclined surface 9 and the back end bottom 10 are different in level. The inclined surface 9 gradually becomes lower in level toward the sump 7 (i.e., in the direction of an arrows X in FIG. 1) and toward the downstream side of the oil flow caused by the rotation of the crankshaft (i.e., in the direction of an arrow Y in FIG. 1).

Figure 3:
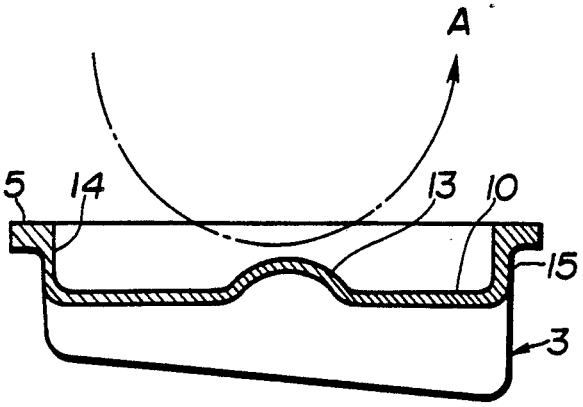
FIG. 3 is a vertical cross-sectional view of the oil pan taken in the direction of arrows substantially along the line III—III of FIG. 1.
Figure 4:
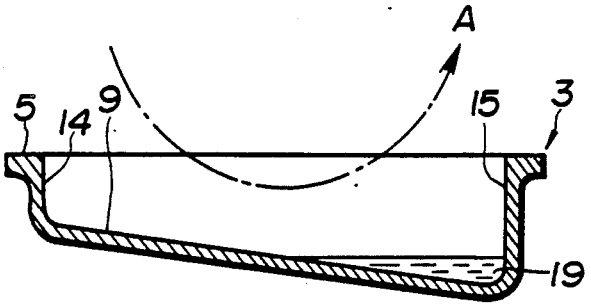
FIG. 4 is a vertical cross-sectional view of the oil pan taken in the direction of arrows substantially along the line IV—IV of FIG. 1.
Figure 5:
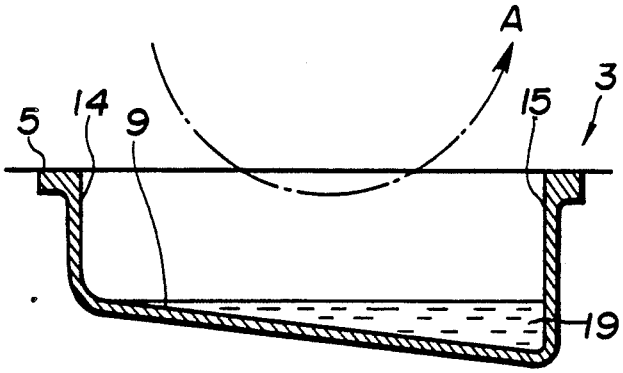
FIG. 5 is a vertical cross-sectional view of the oil pan taken in the direction of arrows substantially along the line V—V of FIG. 1.
Figure 6:
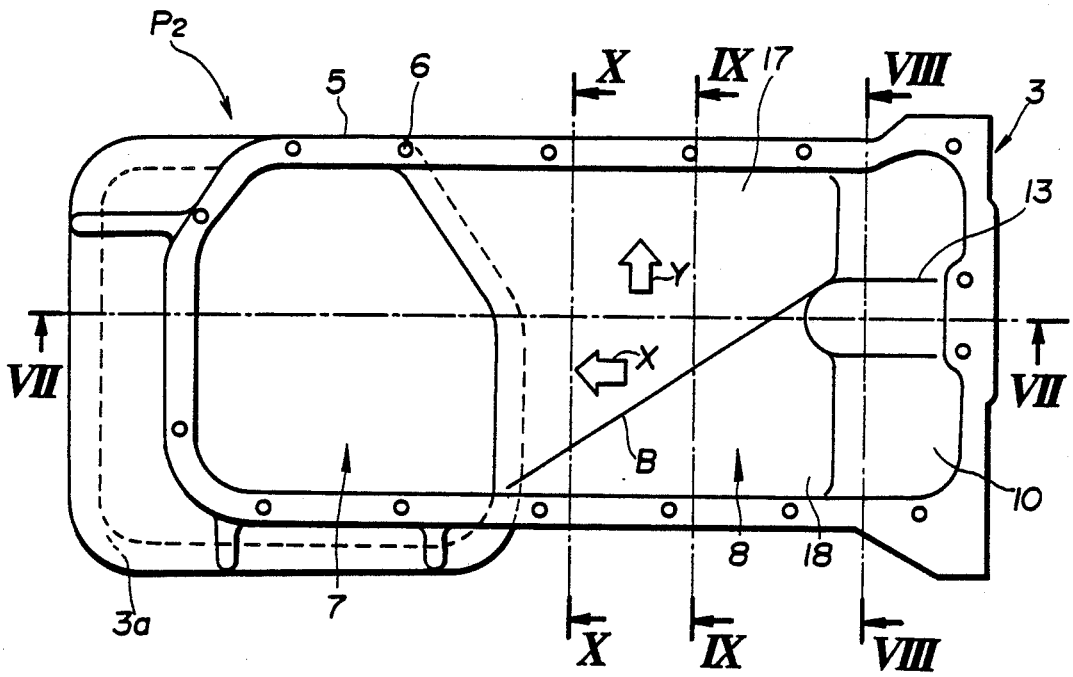
FIG. 6 is a plan view of a second embodiment of an oil pan according to the present invention.
Figure 7:
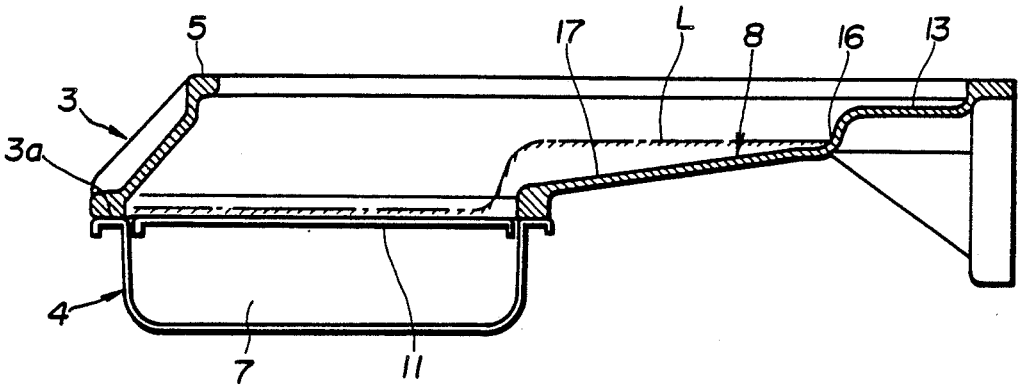
FIG. 7 is a vertical cross-sectional view of the oil pan taken in the direction of arrows substantially along the line VII—VII of FIG. 6.
Figure 8:
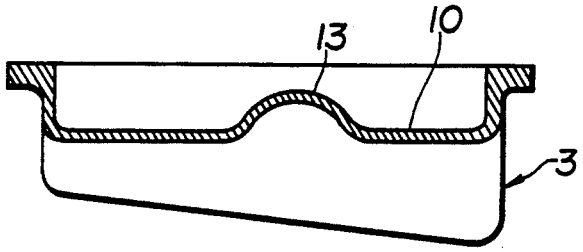
FIG. 8 is a vertical cross-sectional view of the oil pan taken in the direction of arrows substantially along the line VIII—VIII of FIG. 6.
Figure 9:
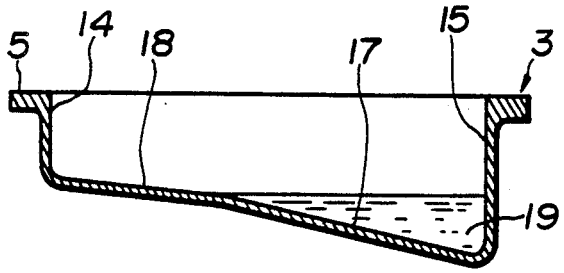
FIG. 9 is a vertical cross-sectional view of the oil pan taken in the direction of arrows substantially along the line IX—IX of FIG. 6.
Figure 10:
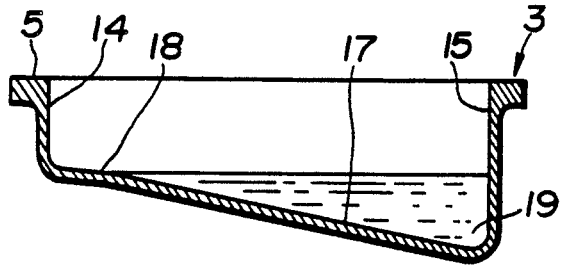
FIG. 10 is a vertical cross-sectional view or the oil pan taken in the direction of arrows substantially along the line X—X of FIG. 6.
Figure 11:
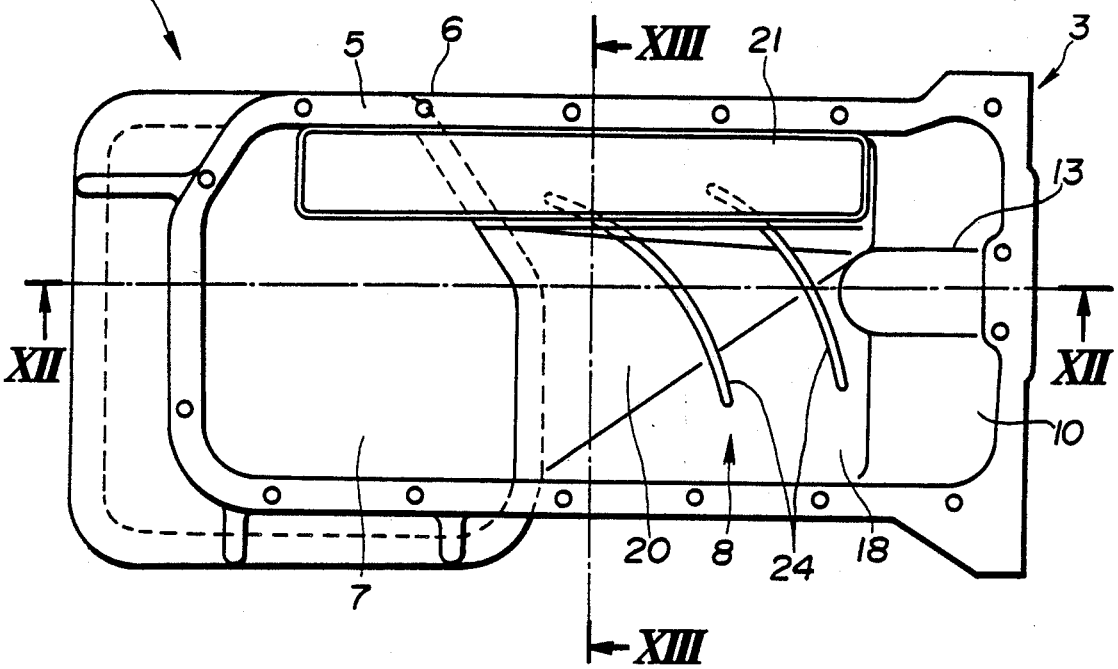
FIG. 11 is a plan view of a third embodiment of an oil pan according to the present invention.
Figure 12:
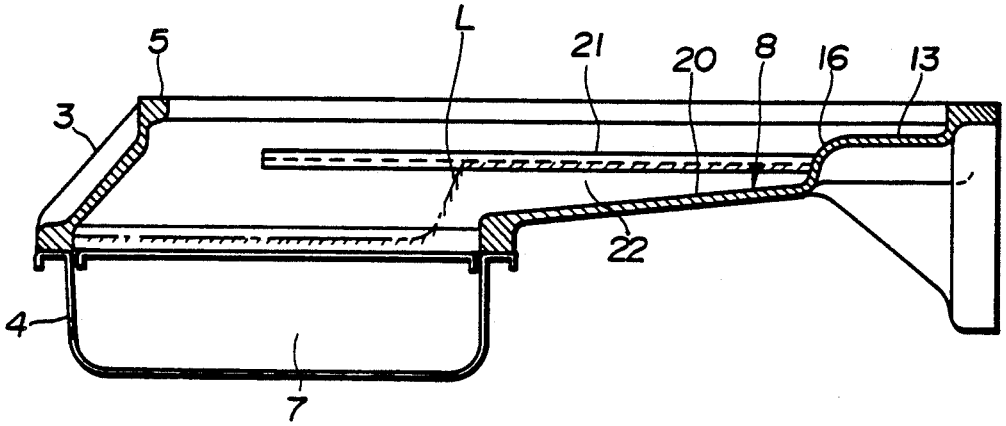
FIG. 12 is a vertical cross-sectional view of the oil pan taken in the direction of arrows substantially along the line XII—XII of FIG. 11.
Figure 13:
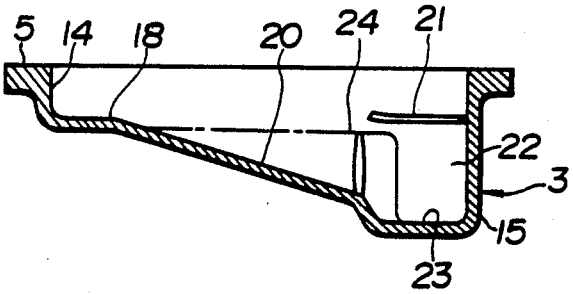
FIG. 13 is a vertical cross-sectional view of the oil pan taken in the direction of arrows substantially along the line XIII—XIII of FIG. 11.

Thus, as the oil pan $P_1$ is viewed from the backward of the engine, the crankshaft and the like are rotated anticlockwise as illustrated by an arrow A in FIGS. 3 to 5 in which the inclined surface 9 gradually becomes lower in level from a left wall 14 to a right wall 15 which are of side walls of the upper oil pan 3 as shown in FIGS. 3 to 5.

As mentioned above, the inclined surface 9 gradually becomes lower in level in the direction of the sump 7. This will be clearly seen from the difference in depth of the shallow bottom section 8 between FIGS. 4 and 5. Thus, the inclined surface 9 is formed to have the lowest level at a part connected to the right wall 15 and communicated with the sump 7. When the engine equipped with the oil pan $P_1$ is mounted in an automotive vehicle, the inclination of the inclined surface 9 is maintained as mentioned above.

The manner of operation of the thus arranged embodiment will be discussed hereinafter.

Under an engine operating condition, the counterweights of the crankshaft and connecting rod big ends (not shown) connected to the crankshaft are rotated in high speeds, thereby generating a strong air flow along the rotational direction. The air flow is directed in the direction of the arrow Y in FIG. 1, on the shallow bottom section 8, so that the oil dropped on the shallow bottom section 8 from a crankcase (not shown) receives the force of the air flow directed in the right hand side of the engine as viewed from the rear of the engine, thereby generating an oil flow in the direction of the arrow Y in FIG. 1.

Furthermore, since the inclined surface 9 is lowered in level toward the sump 7 and toward the downstream side of the oil flow caused by the air flow force under the crankshaft rotation, the above-mentioned air flow force is more strongly applied to the oil on the inclined surface 9 with an increase of height level of the inclined surface 9, so that the oil on the inclined surface 9 is rapidly returned into the sump 7 upon being guided to the side of the right wall 15 of the shallow bottom section 8.

Additionally, since the right wall 15 of the shallow bottom section 8 is located to have a predetermined distance from the crankshaft and the like, the oil at the side of the right wall 15 and on the shallow bottom section 8 hardly receives the above-mentioned air flow force, so that splashing of the oil on the shallow bottom section 8 is largely suppressed.

With this structure, the oil on the shallow bottom section 8 flows into the sump 7 while being collected into the side of the right wall 15 and in the shallow bottom section 8 by the air flow force and the gravity. Thus, the amount of the oil flow on the shallow bottom section 8 becomes larger as approaching the sump 7. This will be seen from an oil level L indicated by a dot-dash line in FIG. 2. However, as shown in FIGS. 4 and 5, since an oil return path 19 defined by the shallow bottom section 8 and the right wall 15 becomes larger in cross-sectional area as approaching the sump 7 in a manner that the inclined surface 9 becomes lower in level as approaching the sump 7, the oil is rapidly returned into the sump 7 without staying on the inclined surface 9.

When the automotive vehicle is inclined in the front-and-aft direction or the automotive vehicle equipped with a transversely mounted engine is changed in a driving condition, the oil in the sump 7 is carried into the shallow bottom section 8 by the centrifugal force caused by the movement of the automotive vehicle. However, with the thus arranged structure, the carried oil can be rapidly returned into the sump 7 through the inclined surface 9. In particular, since the back end bottom 10 is disposed in the vicinity of the counterweights and connecting rod big ends, the oil on the back end bottom 10 is further rapidly returned into the sump 7 upon strongly receiving the air flow force. Therefore, the oil is sufficiently stored in the sump 7 to be smoothly sucked by the oil pump.

Additionally, since splashing of the oil is effectively suppressed, an increase in engine driving loss together with an increase in rotational resistance of the crankshaft is suppressed while the oil is suppressed to be drawn back from the crankcase to the intake system under the action of blow-by gas.

FIGS. 6 to 9 illustrate a second embodiment of the oil pan $P_2$ for a multi-cylinder internal combustion engine, according to the present invention, which is similar to the first embodiment oil pan $P_1$ except for the shape of the shallow bottom section 8 of the upper oil pan 3. The upper oil pan 3 includes an inclined surface 17 and a generally horizontal surface 18 in the shallow bottom section 8. The inclined surface 17 is formed to be lowered in level toward the sump 7 (i.e., in the direction of the arrow X) and downstream side of the oil flow caused by the rotation of the crankshaft (i.e., in the direction of the arrow Y). The horizontal surface 18 is formed on the upstream side of the oil flow caused by the rotation of the crankshaft and the like. A boundary B between the inclined surface 17 and the horizontal surface 18 is located on a line which is formed between the downward corner end of the bulge 13 and the corner formed by the left side wall 14 and a sump side end of the shallow bottom section 8. Furthermore, the inclinations of the inclined surface 17 and the horizontal surface 18 are maintained as mentioned above when the engine equipped with the oil pan $P_2$ is mounted in an automotive vehicle.

With the thus arranged structure, since the horizontal surface 18 is formed at the side of the left wall 14 and on the shallow bottom section 8, the oil on the horizontal surface 18 flows in close vicinity to the crankshaft. Therefore, the oil acceleratedly flows into the sump 7 since the oil on the shallow bottom section 8 strongly receives the air flow force on the horizontal surface 18. Additionally, since the inclined surface 17 is gradually lowered in level toward the sump 7 and toward the downstream side of the oil flow caused by the rotation of the crankshaft upon being formed to enlarge the cross-sectional area of the oil return path 19 toward the sump 7. Accordingly, the oil is prevented from staying on the shallow bottom section 8, so that the oil on the shallow bottom section 8 rapidly flows into the sump 7.

FIGS. 11 to 14 illustrate a third embodiment of the oil pan $P_3$ for a multi-cylinder internal combustion engine, according to the present invention, similar to the first embodiment oil pan $P_1$. The oil pan $P_3$ comprises the shallow bottom section 8 which includes the horizontal surface 18, an inclined surface 20 and a guide plate 21. The guide plate 21 is formed to generally horizontally protrude from the right wall 15. The guide plate 21 and the shallow bottom section 8 defines an oil return path 22 therebetween. The oil return path 22 is opened to the upstream side of the oil flow caused by the rotation of the crankshaft. The guide plate 21 extends from the shallow bottom section 8 to the sump 7. The oil return path 22 has a bottom 23 which is formed at the side of the right wall 14 and on the shallow bottom section 8 to be lower in level than the inclined surface 20. The inclined surface 20 is formed in a generally triangular shape between the path bottom 23 and the horizontal surface 18. The shallow bottom section 8 further has two ribs 24 which are curved in an arcshape so as to gradually approach the sump 7. Each of the ribs 24 is extended from the horizontal surface 18 to the under side of the guide plate 21 to accelerate the velocity of the oil flow. The guide plate 21 is secured to the upper oil pan 3 through the rib 24 and a boss 26 projecting from the path bottom 23 with screws 25.

The baffle plate 11 has a plurality of louvers 27 which include louver fins **27*a* and are formed with slits 27*b* through which the sump 7 is communicated with the space defined by the shallow bottom section 7. The louver fins 27*a* are formed inclined upwardly opposite to the oil flow caused by the crankshaft under rotation, so that the oil is effectively guided into the sump 7. The baffle plate 11 has an opening 28 at its central part so that an oil strainer (not shown) can pass through the opening 28 into the sump 7. The lower oil pan 4 including the baffle plate 11 is secured to the lower surface 3*a* of the upper oil pan 3 with bolts 29**.

Figure 14:
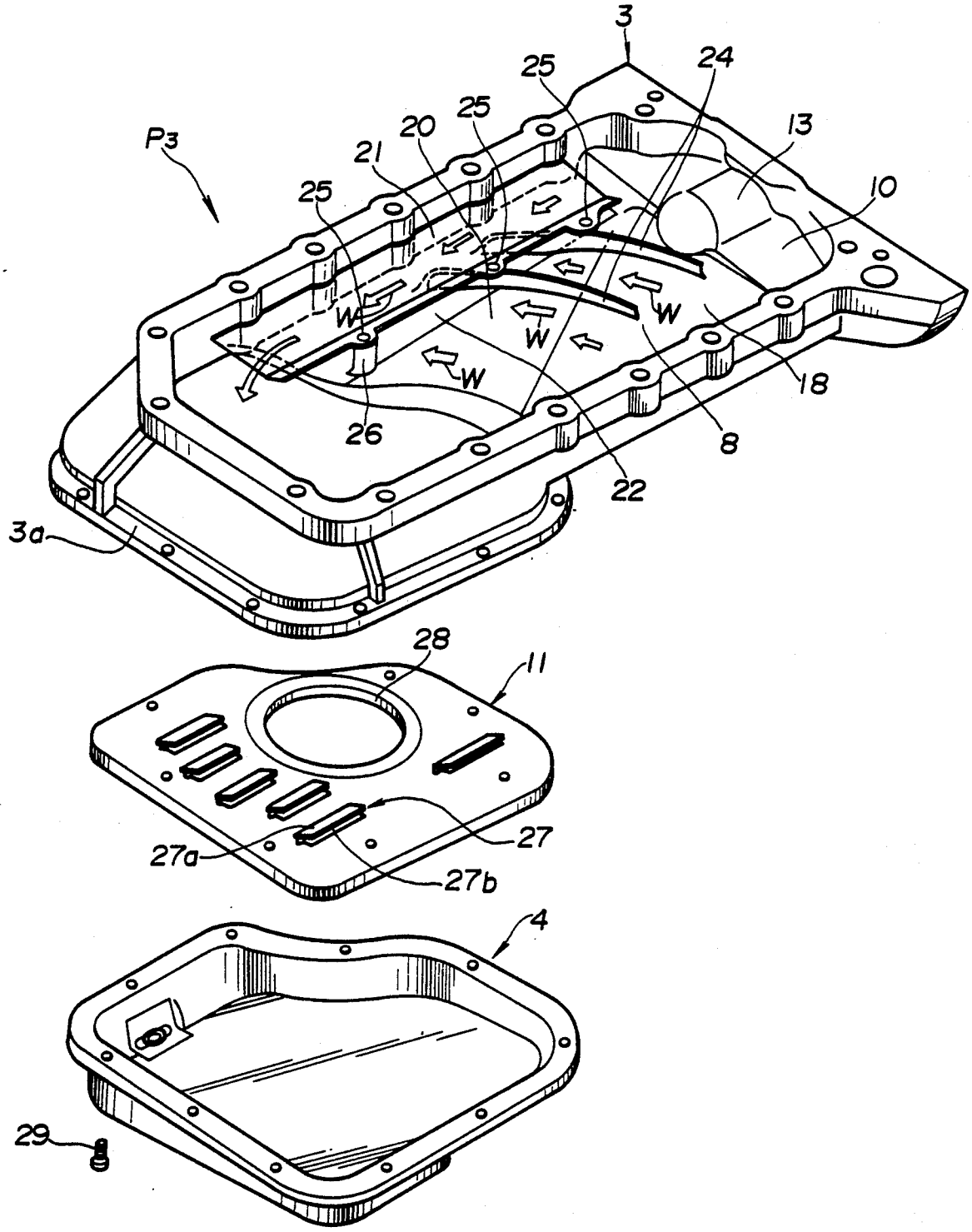
FIG. 14 is an exploded perspective view of the oil pan of FIG. 11.
Figure 15:
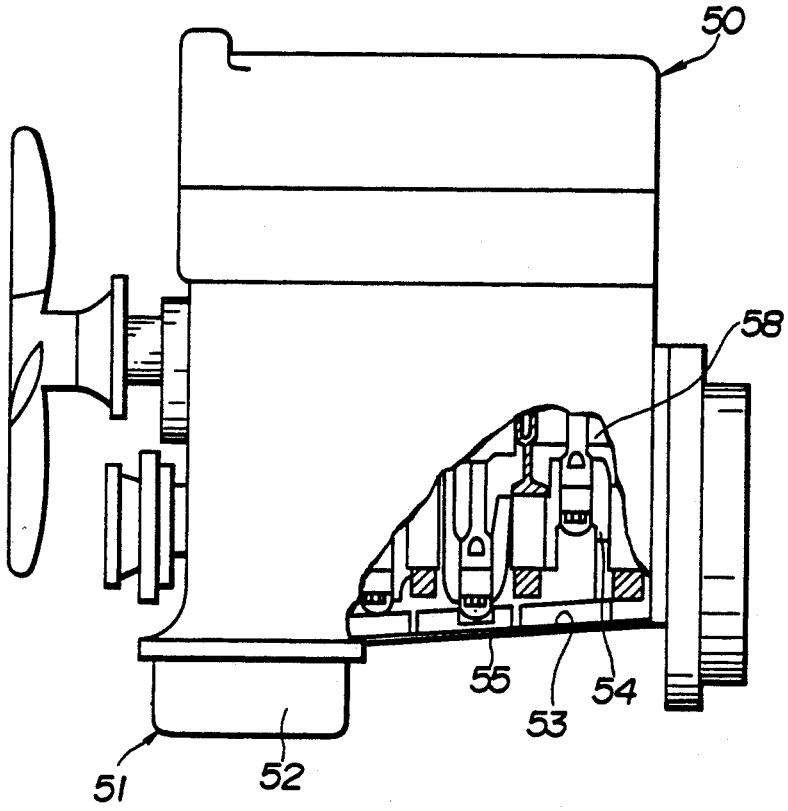
FIG.15 (PRIOR ART)
FIG. 15 is a side view, partly in section, of a conventional engine provided with a conventional oil pan.
Figure 16:
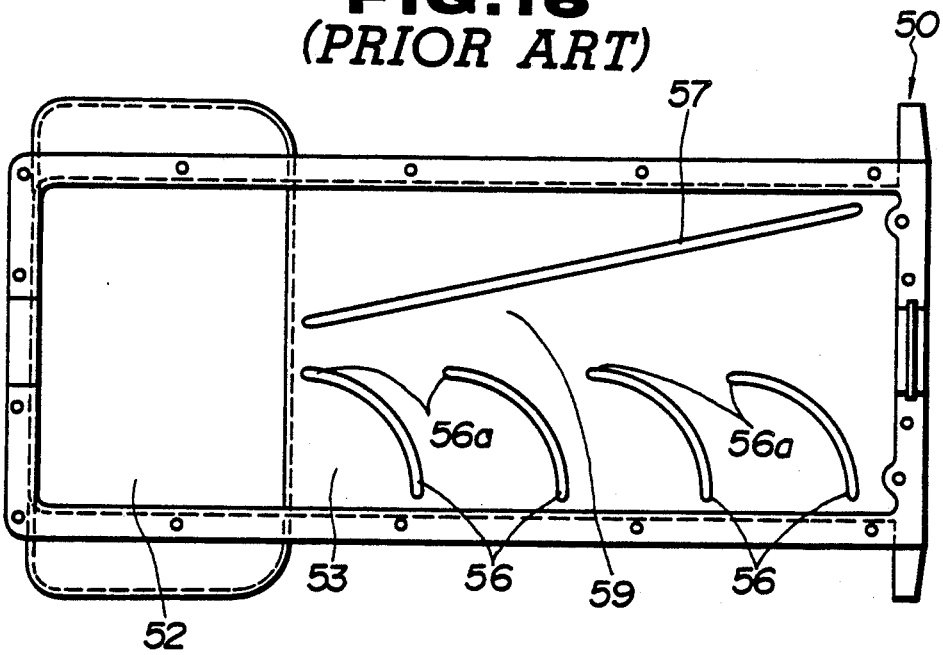
FIG.16 (PRIOR ART)
FIG. 16 is a plan view of the oil pan shown in FIG. 15.

With this structure, the oil dropped on the shallow bottom section 8 flows into the oil return path 22 along the guide ribs 24 as indicated by arrows W in FIG. 14 since the oil receives the air flow force which is directed to the downstream side of the shallow bottom section 8 under the rotation of the crankshaft and the like. Furthermore, since the velocity of the oil flow into the sump 7 is promoted by the inclined surface 20 and the ribs 24, the oil is rapidly returned into the sump 7.

When the automotive vehicle is inclined in the front-and-aft direction or the automotive vehicle equipped with a transversely mounted engine is changed in driving condition, the oil in the sump 7 is carried into the shallow bottom section 8 by the centrifugal force caused by the movement of the automotive vehicle. However, with the thus arranged structure, since the upper side of the oil return path 22 is covered with the guide plate 21, almost all the oil splashed by the crankshaft and the like is received by the guide plate 21, so that the amount of the splashed oil in the crankcase can be decreased. This largely decreases the amount of the oil carried into an intake system with blow-by gas. Furthermore, the splashed oil collected in the oil return path 22 is rapidly returned into the sump 7. Additionally, since the oil in the oil return path 22 hardly receives the air flow force caused by the rotation of the crankshaft and the like in a manner of the guide plate 21, the oil in the oil return path 22 is prevented from mixing with air bubbles while promoting separation of the oil and air bubbles, so that mixing of the air bubbles with the oil is suppressed when the oil is sucked into the oil pump.

What is claimed is:

1. An oil pan for an internal combustion engine, comprising:

means defining a sump located under a cylinder block of the engine, said sump storing lubrication oil therein; and a shallow bottom section fixedly disposed under a cylinder block of the engine, and sealingly connected with said sump defining means, said shallow bottom section being located higher in level than a bottom of said sump and including an inclined surface which gradually becomes lower in level toward said sump and toward a downstream side of an oil flow caused by rotation of a crankshaft of the engine and adjacent an oil pan side wall so as to form an oil return path to the sump, said shallow bottom section being fluidly communicated with said sump.

2. An oil pan as claimed in claim 1, wherein said shallow bottom section includes a generally horizontal surface which is integrally connected with said inclined surface, said horizontal surface located upstream of the oil flow caused by the rotation of the crankshaft.

3. An oil pan as claimed in claim 1, wherein said shallow bottom section defining thereon an oil return path which is located at the downstream side of the oil flow caused by the rotation of the crankshaft, said oil return path having a path bottom integral with said inclined surface, said path bottom being lower in level than said inclined surface.

4. An oil pan as claimed in claim 3, wherein said shallow bottom section is provided with a plurality of ribs which extend from an upstream side of the oil flow caused by the rotation of the crankshaft to said path bottom and curves toward said sump, an end of said rib extending toward an inlet of said return path inlet.

5. An oil pan as claimed in claim 1, wherein said shallow bottom section includes a generally horizontal surface which is located at the upstream side of the oil flow caused by rotation of the crankshaft on the shallow bottom section.

6. An oil pan as claimed in claim 1, wherein said oil pan includes an upper oil pan and a lower oil pan, said lower oil pan being sealingly secured to said upper oil pan and located lower in level than said upper oil pan, said upper oil pan including said shallow bottom section, said lower oil pan defining said sump thereinside.

7. An oil pan as claimed in claim 6, wherein said the upper oil pan is made of aluminum alloy casting, and the lower oil pan is made of sheet metal.

8. An oil pan as claimed in claim 1, wherein said shallow bottom section has a back end bottom which is located at the rear section of said shallow bottom section, said back end bottom connected with said inclined surface through a step section.

9. An oil pan as claimed in claim 1, further comprising a guide plate which generally horizontally projects from a side wall located at the downstream side of the oil flow caused by the rotation of the crankshaft, said guide plate extending from said shallow bottom section to said 10. An oil pan as claimed in claim 4, further comprising a guide plate which generally horizontally projects from a side wall located at the downstream side of the oil flow caused by the rotation of the crankshaft, said guide plate extending from said shallow bottom section to said sump.

11. In an automotive vehicle equipped with an internal combustion engine having an oil pan, the oil pan comprising:

means defining a sump located under a cylinder block of the engine, said sump storing lubrication oil therein, a shallow bottom section fixedly disposed under a cylinder block of the engine, and sealingly connected with said sump defining means, said shallow bottom section being located higher in level than a bottom of said sump and including an inclined surface which gradually becomes lower in level toward said sump and toward a downstream side of an oil flow caused by rotation of a crank shaft of the engine and adjacent an oil pan side wall so as to form an oil return path to the sump, said shallow bottom section being fluidly communicated with said sump.

12. An apparatus comprising:

an automotive vehicle having an internal combustion engine;

an oil pan having means defining a sump located under a cylinder block of the engine, said sump storing lubrication oil therein, a shallow bottom section fixedly disposed under a cylinder block of the engine, and sealingly connected with said sump defining means, said shallow bottom section being located higher in level than a bottom of said sump and including an inclined surface which gradually becomes lower in level toward said sump and toward a downstream side of an oil flow caused by rotation of a crank shaft of the engine and adjacent an oil pan side wall so as to form an oil return path to the sump, and said shallow bottom section being fluidly communicated with said sump, and wherein said inclined surface of the shallow bottom section gradually becomes lower in level toward said sump and toward the downstream side of the oil flow caused by the rotation of the crankshaft of the engine when the engine equipped with the oil pan is mounted in the automotive vehicle.

13. An apparatus comprising:

an automotive vehicle having an internal combustion engine;

an oil pan having means defining a sump located under a cylinder block of the engine, said sump storing lubrication oil therein;

a shallow bottom section fixedly disposed under a cylinder block of the engine, and sealingly connected with said sump defining means, said shallow bottom section being located higher in level than a bottom of said sump and including an inclined surface which gradually becomes lower in level toward said sump and toward a downstream side of an oil flow caused by rotation of a crankshaft of the engine, said shallow bottom section being fluidly communicated with said sump;

wherein said shallow bottom section includes a generally horizontal surface which is integrally connected with said inclined surface, said horizontal surface being located upstream of the oil flow caused by the rotation of the crankshaft; and wherein said horizontal surface is horizontally disposed when the engine equipped with said oil pan is mounted in the automotive vehicle.

* * * * *